United States Patent [19]

Ponzellini

[11] 4,178,858

[45] Dec. 18, 1979

[54] DISASSEMBLABLE TABLE

[75] Inventor: Giulio Ponzellini, Bologna, Italy

[73] Assignee: Anonima Castelli S.p.A., Italy

[21] Appl. No.: 861,430

[22] Filed: Dec. 16, 1977

[30] Foreign Application Priority Data

Apr. 29, 1977 [IT] Italy ..... 49200 A/77

[51] Int. Cl.[2] ..... A47B 13/02

[52] U.S. Cl. ..... 108/150; 108/153; 248/188.7

[58] Field of Search ..... 108/150, 153; 248/188.7, 529, 165, 188.1; 285/338, 346, 196; 403/217, 218, 219, 374, 369, 370; 85/70, 67; 280/381 R, 287

[56] References Cited

U.S. PATENT DOCUMENTS

| | | | |
|---|---|---|---|
| 641,895 | 1/1900 | Scovill | 85/70 |
| 2,055,761 | 9/1936 | Gerschefski | 248/165 |
| 2,075,714 | 3/1937 | Hamill | 85/70 X |
| 3,504,498 | 4/1970 | Triplett | 85/70 |
| 3,863,876 | 2/1975 | Finkelstein | 248/529 X |
| 3,877,669 | 4/1975 | Ambasz | 248/188.7 |

FOREIGN PATENT DOCUMENTS

| | | | |
|---|---|---|---|
| 2615527 | 4/1976 | Fed. Rep. of Germany | 248/188.7 |
| 2615528 | 4/1976 | Fed. Rep. of Germany | 248/188.7 |
| 1214770 | 11/1959 | France | 248/529 |

*Primary Examiner*—James T. McCall

*Attorney, Agent, or Firm*—McGlew and Tuttle

[57] ABSTRACT

A table comprising a vertical column provided at the upper end with a plurality of radially outwardly directed arm members for supporting the table top and at the lower end with radially outwardly directed foot members detachably connected thereto said arm and foot members having their inner cylinder sector-like portions at least the end portions of the column being hollow and the inner sector-like elements of the arm and foot members are dimensioned to form together respectively at least a part of a hollow cylindrical body adapted to be received at least partially inside one of said hollow end portions of the column respectively, sector-like members of different angular amplitudes being provided to be arranged between said inner sector-like elements of the arm members and foot members respectively, which fill the space therebetween when necessary, an expansion locking device being coaxially mounted inside the hole defined in combination by said sector-like elements adapted to apply a radial pressure on said sector-like elements on at least one zone placed inside the hollow end portions of the column.

11 Claims, 9 Drawing Figures

DISASSEMBLABLE TABLE

The present invention relates to a table of the kind which can be easily assembled and dismantled.

The table comprises a table top supported by at least one vertical column provided at the upper end with a plurality of detachable radially directed arm members, and at the lower end with a plurality of detachable radially outwardly directed foot members, the two pluralities of arm members and foot members being constituted of members identical to each other, said arm and radial members being provided on their inner ends with portions externally shaped as a sector of a hollow cylindrical body of such a size to be partially received inside the respective hollow end portions of said column which is hollow or has at least hollow end portions, preferably constituted of inserted pieces mounted on said column, said sector-like inner elements of said plurality of arm members of foot members forming together at least a part of an axial hole, inside of which is inserted an expansion locking device adapted to urge radially outwardly said sector-like elements against the inner surface of the end portions of the column or of inserted pieces fixed thereto.

The disassembly of the support structure of this table can be therefore carried out by simply releasing the two expansion locking devices inserted between the plurality of sector-like end portions of the arm members supporting the table top or of the foot members, the arm or foot members being provided in a number less than a predetermined maximum whole number according to which will be determined the angular amplitude of said sector element of the inner end portion of each arm or foot member.

Each sector-like element can have an angular amplitude equal to 360°:n, where n is a whole number which can vary from 2 to 5.

It is to be noted that in reality each sector will have an angular amplitude of 360°:n−a, where a is the angular amplitude of a small gap which is necessary in order to allow that the respective sector-like end portions of the arm and foot members can be locked by an expansion locking device against the inner wall of their locking seats, i.e., the inner end portions of a hollow column. Disassemblable tables are already known having at least one vertical carrying column, which is connected at its upper end with a plurality of radially outwardly directed detachable arm members and with a plurality of radially outwardly directed foot members, detachably connected thereto, at its lower end.

According to the known solutions, provision has been made to shape each inner end portion of said arm and foot members so as to form a joint member to be inserted into one of a plurality of complementary joint members which are radially and circunferentially uniformely spaced along the periphery of a mounting member provided at the upper and lower ends of each column and releasably held together by being clamped between the head of a single bolt and a nut screwed thereon with the interposition of stop washers.

This system requires to construct inserted pieces shaped in a particular manner and to be mounted at the ends of each column and arm members and foot members shaped in complementary way in respect to the cooperating engaging seats arranged in said mounting members.

That increases considerably the production costs, requires a high accuracy and makes necessary to use a greater number of the components which are necessary to allow to compose different table patterns.

In the fact when one desires to vary the table pattern, by varying the number of its feet, or if one desires tables in which the table top is carried by more than one column (and in this case the number of the foot members could be reduced (without altering the table stability), substantially two solutions have been proposed.

The first solution requires to have at disposal a plurality of mounting members as well as of arm and foot members corresponding to the number of the engaging seats which are provided in said mounting members. The second solution provides to construct a mounting member on which a single annular engaging seat is arranged into which will be engaged the duly shaped inner sector-like portions of the arm members and/or foot members having inner end portion equal to each other and which are inserted with the juxtaposition of sector-like spacing pieces selected between a plurality of spacing pieces of different angular amplitude so as to complete a round angle, in the event that the number of the arm members of the foot members is less than a predetermined maximum value.

The present invention takes advantage of this latter solution and therefore it provides to employ a plurality of arm members and a plurality of foot members having identical sector-like inner portions and a series of sector-like spacing pieces of different angular amplitudes to be inserted between said arm or foot members in the case that the numbers of these latter is less than a predetermined maximum number, but without requiring the presence of the shaped mounting members of the prior art, since according to the present invention it is only necessary to employ a hollow metal columns or a columns having at least hollow ends, while the inner ends of the arm and foot members to be shaped as simple cylindrical sector so that they are little expensive to produce.

In addition the components of the table equipment are very few since arm members and foot members of a sole type are required.

A further advantage of the present invention consists in the fact that there is no problem of a processing accuracy as, on the contrary was the case of the cited known solutions. In the fact these latter provided that the connection of the inner end portions of the arm and foot members were shaped as joint members to be engaged in complementary joint members provided on the mounting members, according to this solution any size error or defect could result in an undesired swinging of the respective arm member or foot members, and that is detrimental to the table stability or to the correct horizontality of its table top.

These and other characteristics and advantages of the present invention will be better understood from the following specification of some embodiments of the disassemblable table of this invention and in which.

Figure 1:
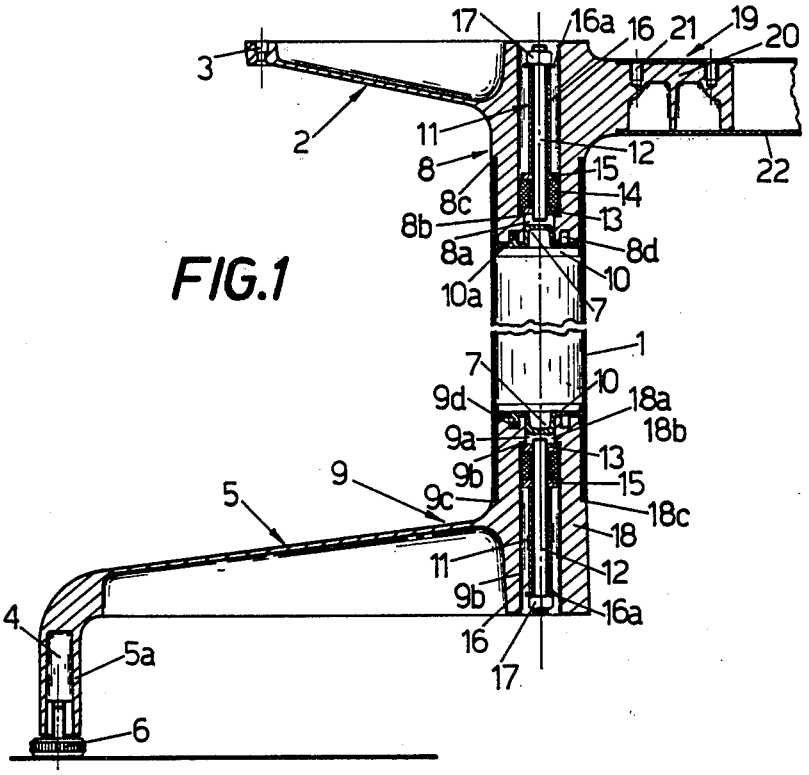
FIG. 1 is a partial axial section of a first embodiment of this invention.

FIGS. 5 to 9 diagrammatically show a table top support structure having 2, 3, 4 and 5 foot members, respectively.

Referring to the drawings, at 1 is generally marked a tubular metal column, while at 2 are generally marked the arm members supporting a table top (not shown), connected thereby by screws, received into screw seats 3 arranged on the outer end portions of said extending radially outwardly arm members 2.

Accordingly at 5 are generally marked the foot members, which at their outer ends are bent downward to form legs 5*a* each provided with a recess 4 for the insertion of an adjustable ground engaging stud or the like 6, which is per se conventional.

The inner end portions of the arm members 2 and of the foot members 5 to be disassemblably connected to the columns 1 form two substantially identical systems. The end portions of said members 2 and 5 are indicated 8 and 9 respectively and the parts operatively identical thereof will be indicated with a same letter. For this reason only the end portion 9 of a foot member 5 engaging the lower end of the column will be described.

Figure 3:
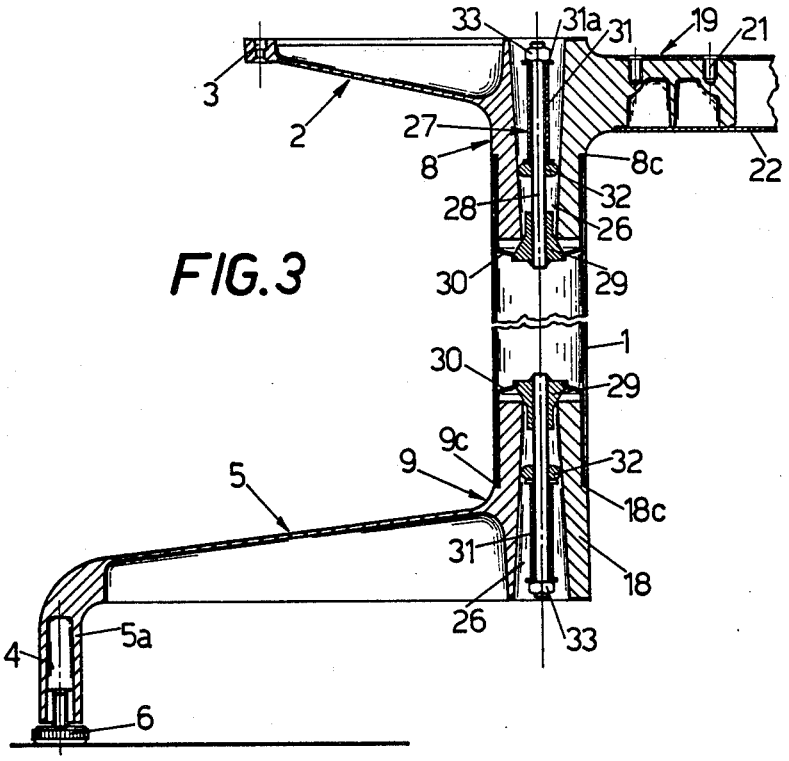
FIG. 3 is similar to FIG. 1, but it shows another more improved variant of the expansion locking device which is operative in two zones instead of one, as provided in the embodiments of FIGS. 1 and 2.

Now referring to the FIGS. 1 and 3 each foot member 5 at its inner end forms an element 9 in the form of a cylindrical sector, provided with a cavity in the form of a cylindrical sector 9*a*; each of the elements 9 has an angular amplitude of 360°:n−a, where n in the shown embodiment is equal to 5 and a is a very small angle adapted to create a gap between the adjacent elements 5 sufficient to allow that they can be pressure locked against the inner surface of the lower end portion of the hollow column 1.

On the outer surface of each sector-like element 8 of each arm member 2 below its upper end and on the outer surface of the sector-like element 9 over the lower end thereof a partial annular outer shoulder is provided 8*c* and 9*c* respectively so as to enable that a portion of said sector-like elements 8 and 9 has an outer diameter equal to that of the column while the remaining portion has a diameter adapted to be fitted inside said column 1.

At 10 is indicated a thin transverse positioning disc which is provided with a central cap 7 extending axially and adapted to be received inside the axial hole defined in combination by the cavities 8*a* and 9*a* respectively of the elements 8 and 9 through the inner orifice of said hole.

Said disc 10 is provided with at least a boss 10*a* or the like designed to be received into one of complementary recesses 8*d* or 9*d*, arranged in the inner end of the elements 8 and 9, and which after its fitting therein permits the correct positioning of said cup and prevents any further rotation of said cup 7.

Also on each surface 8*a* and 9*a* a shoulder 8*b* and respectively 9*b* is arranged to duly define the position the expansion locking device, generally indicated 11, in the embodiment shown in FIG. 1. Each device 11 comprises a threaded vertical rod 12 which at its inner end which will be received inside the column 1 is made integral with a stop washer 13 abutting against said annular shoulder formed in combination by the partial shoulders 8*d* or 9*d*. About the rod 12 and in contact with said washer 13 is mounted a cylindrical sleeve made of an elastically deformable material hardened caoutchouc, for instance, against which rests a second washer 15 made integral with a hollow tube 16, acting as a spacer an ending towards the outside with an outer flange 16*a*. On the threaded end of the rod 12 above the flange 16*a* a nut 17, is screwed. By screwing said nut 17 on the rod 12 by means of a wrench, the relative approach of the two washers 13 and 15 is caused and as a result thereof the deformation of the interposed elastic sleeve 14 is produced so that said sleeve will tend to take an outer convex toric shape, pressing against the inner walls of the cavities 8*b* or 9*b*, urging the respective elements 8 or 9 against the inner surface of the column 1. For such a purpose the shoulders 8*b* and 9*b* are arranged at such a height that the system consisting of the washers 13 and 15 and the deformable sleeve 14 interposed between these latter, is positioned in that part of the plurality of the elements 8 or 9 which is located inside the column 1.

In the case that the number of the employed arm members 8 or the foot members 9 is less that the maximum predetermined number n=5, spacers 18 are provided which are shaped in an identical manner as the inner sector-like elements 8 and 9, and which have a cylindrical outer surface of the same diameter as that of the column 1 with shoulders 18*c*, but which have different angular amplitudes, in FIGS. 1 and 3 a spacer 18 being shown inserted between two adjacent foot members 5. Assuming that the maximum number of foot or arm members is five and the minimum number is 2, the spacers 18 will be of the angular amplitudes 18°, 48° and 108°.

At the upper part and on the right hand of the FIGS. 1 to 4, instead of an arm member 2, provided with a sector-like inner portion 8 has been substituted a sector-like inserted piece 19 mounted at the ends of a bracing bar 22, said piece 19 being shaped identically as an inner end portion 8 and it extends outwardly with a projecting arms 20 which is connected by means of screws 21 to the hollow bracing bar 22 serving to brace together two columns 1. Of course, at the other end said bar 22 will have an identical inserted piece 19 to be inserted in the second column 1 together with the sector-like element 8 of the arm members 2 and if it is necessary, with the interposition of spacers 18, the same solution can be also applied at the lower ends of said two columns 1.

Figure 2:
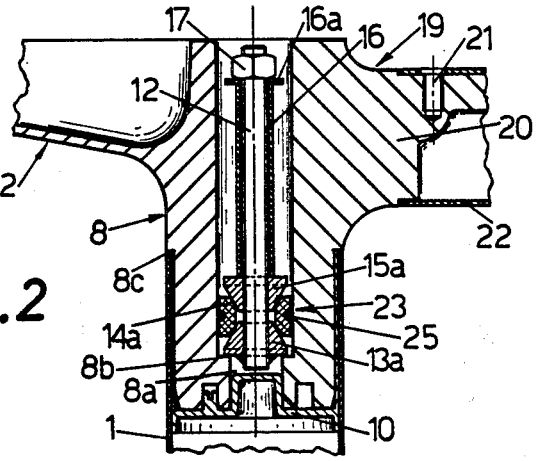
FIG. 2 shows the detail of the connection part of the arm members of FIG. 1 with a variant of the expansion locking device.

FIG. 2 shows a variant of the expansion locking device which in this embodiment is generally indicated 23. The same references which have been used in respect to the device 11 are used for the parts of the device 23 which are not modified.

In the device 23 the washers 13 and 15 of the device 11 are substituted by two cones 13*a* and 13*b*, while the sleeve 14 is now substituted by three or four sleeve sectors 14*a* which are held together by an elastic ring 25 received into an annular groove arranged in the intermediated peripheral zone of said sectors 14*a*.

Figure 4:
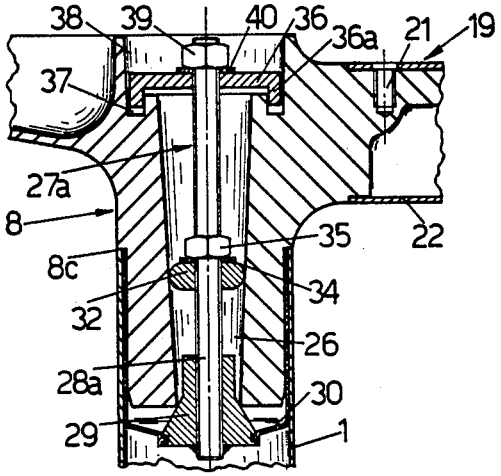
FIG. 4 is a detail of the connection part of the arm members, according to the embodiment of FIG. 3, but in which the expansion locking device, acting on two different zones, includes a safety lock nut.
Figure 5:
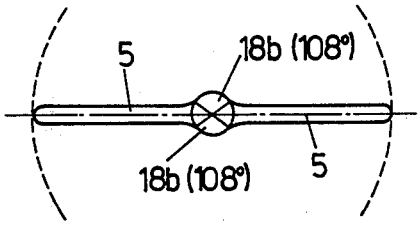
Figure 6:
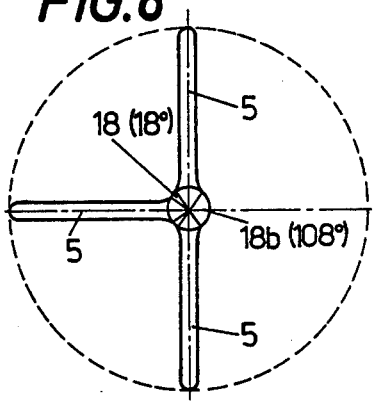
Figure 7:
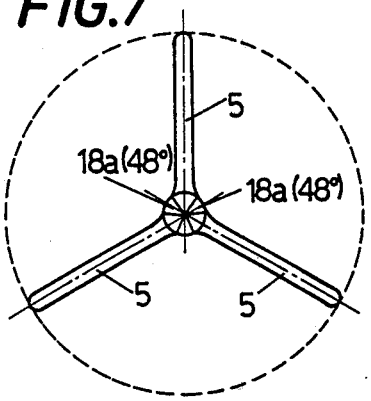
Figure 8:
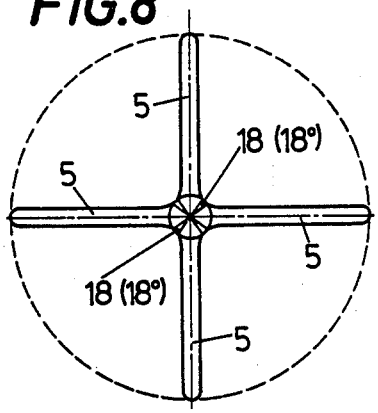
Figure 9:
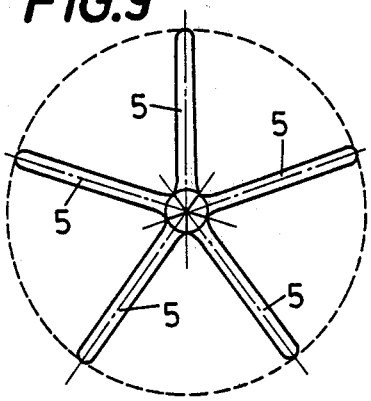

The expansion locking devices of the variants shown in FIGS. 3 and 4 require a light modification of the end portions 8 and 9 of the arm and foot members 2 and 5 but said locking devices ensure a locking of a higher liability. In these variants there are still the outer shoulders 8*c* and 9*c*, but the sector-like element 8, 9, 18 and 19 form in combination an inner conical hole 26, instead of having a shouldered cylindrical hole 8*a*, 8*b* the cross section area of said hole 26 decreasing proceeding from the outside towards the inside of the column 1.

The expansion locking device 27 of FIG. 3 comprises a threaded rod 28 that at its end, facing the inside of the column 1, is made integral with an abutting conical body 29 resting on the edge of the inner orifice of the conical hole 26 and which is made integral with a retaining cup-like member 30 made of plastics, which will be introduced inside the orifice of the column up to attain the outer shoulder 8*c* or 9*c*. Around the rod 28 a hollow tube 31 is mounted, so long that its innermost end be located always inside the column 1, and on this inner end a toric ring 32 made of hardened rubber, is fixed while at the other end said tube 31 extends outwardly with a flange 31*a* from which end extends outwardly the threaded rod end portion 28 on which a locking nut 33 is screwed. Thus by screwing with force the nut 33 by means of a wrench about said rod 28 the ring 32 is caused to approach the abutting cone 29. As a results thereof, two radial expansion effects are created, the first of which produced by the cone 29 tends to push outwardly the lower ends of the elements 8 or 9 (and 18, 19) respectively against the inner surface of the column 1, and a second radial effect due to the ring 32 which, owing to the tapered shaped of the hole 26, tends to approach the ring 32 to the cone 29, i.e, tends to move the ring 32 towards the narrower portion of the hole 26 so that said ring 32 urges towards the outside also in an intermediate part thereof, as well as the spacers 18 and/or the elements 19 of the bracing bar 22 which may be interposed.

According to the variant of FIG. 4 the expansion device 27*a* is operatively identical to the device 27 shown in FIG. 3, except that the tube 31 is eliminated and the toric annular body 32 is mounted directly on the threaded rod 28*a*. On the toric ring 32 is mounted a metal washer 34 and a locking nut 35. About the outer end of the rod 28*a* is mounted a disc-like member 36 engaging an annular groove 37 by means of a peripheral flange 36*a* bent downwardly said groove being arranged at an enlarged cylindrical portion 38 of the conical hole 26 of the inner surfaces of the sector-like elements 8, 9, and, when used, in the elements 18 and 19. A nut 39 is mounted on the rod 28*a* with the interposition of a metal washer 40 thus allowing to obtain a safety locking of the device 27*a* which will be mounted in its operative position after having removed the nut 39, the washer 40 and the disc-like member 36; by engaging the nut 35 with a tubular wrench, and then screwing with force the nut 35 on the rod 28*a*.

Then the disc-like body 36, the washer 40 and the nut 39 are mounted this latter acting as a safety lock nut.

FIGS. 5 to 9 show diagrammatically several mutual dispositions of the foot members 5 so as to obtain supporting members for table-tops of different patterns by using or not spacers 18, 18*a*, 18*b* of the various angular amplitudes of 18°, 48° and 108°.

What we claim is:

1. A table comprising at least a vertical column provided at the upper end with a detachable support structure supporting a detachable table top and constituted of a plurality of radially outwardly directed arm members detachably connected to the upper end of said column, while at the lower end of this latter a plurality of radially outwardly directed foot members are detachably connected, said arm and foot members having their inner portions shaped as sectors of a same hollow cylindrical body, characterized by the fact that at least the end portions of each column are hollow and the inner sector-like elements of the arm and foot members are shaped and dimensioned to form together respectively at least a part of a hollow cylindrical body adapted to be received at least partially inside one of said hollow end portions of said column respectively a plurality of sector-like members of different angular amplitudes being provided to be inserted between said inner sector-like elements of the arm members and foot members respectively, acting as spacers to complete each hollow cylindrical body, an expansion locking device being coaxially mounted inside the hole defined in combination by each set of said sector-like elements of the arm members, the foot members and the spacers and which apply a substantially radially outwardly directed pressure effect on said sector-like elements on at least one zone placed inside the hollow end portions of the column.

2. A table according to claim 1, wherein the angular amplitude of the inner sector-like elements of the arm or foot members is equal to 360°:n−a, where n is the maximum number of the arm or foot members which is provided, and a is a small angle to create a gap between the adjacent sector like elements, sufficient to allow a small radial outwardly directed displacement thereof, enabling said elements to be locked against the inner surface of the column.

3. A table according to claim 1, wherein the outer surface of each sector like element is provided with an annular shoulder facing the adjacent column end, the outer diameter of said elements being equal to the outer diameter of the column, while the outer diameter of said elements beyond said shoulders is such that this part of each sector-like element enters inside the hollow end portions of the column, said shoulders serving to correctly defining the portions of said elements to be received inside the column ends.

4. A table according to claim 1, wherein the inner hole defined in combinazion by all the sector-like elements has an annular shoulder forming an annular step near the inner end of said hole, and the expansion locking device comprises a threaded rod to be mounted concentric with said hole and made integral at its inner end with a first washer designed to abut against said annular shoulder, while a second similar washer rests against the first washer with the interposition of a sleeve of hardened caoutchouc or the like said second washer being made integral with a tubular body freely mounted around said rod and forming at its upper end a flange of an outer diameter less than the inner diameter of the said hole, upon said flange a nut being screwed on said rod, the screwing of which produces the relative approach of said washers and, as a result thereof, the outer bulging of the sleeve which causes the sector-like elements to be pressure locked against the inner surface of the column.

5. A table according to claim 4, wherein the washers have the form of truncated cones having their smaller bases facing one another while the sleeve is formed by sleeve sectors, which are held together by an elastic ring inserted inside an annular groove arranged on the outer surface of the set of sleeve sectors.

6. A table according to claim 1, wherein the inner hole formed in combination by the sector-like elements is conical and tapered innerwardly with respect of the column, and wherein the expansion locking device includes two expansion locking systems operating in parallel planes set at right angles to the axis of the column, but inside said column, said locking device comprising a threaded, rod at the inner end of which is mounted a first conical washer shaped to be partially inserted into the inner smaller orifice of the conical hole defined by the sector-like elements, while at a distance from said conical washer less than the distance between said inner hole end and the outer shoulder from said conical washer a second toric washer is freely mounted around the rod, and which in unstressed condition slightly contacts the surface of the inner conical hole, on said second washer resting the lower flange of a tubular body freely mounted about the rod and having another flange at its opposite end, which upper flange is positioned near the outer end of said hole and supports a nut screwed on the rod so that the screwing of said nut causes the first and second washers made of elastically deformable material to relatively approach one another creating radially pressure forces urging the sector like members to be locked against the inner surface of the column along two parallel circular bands.

7. A table according to claim 1, wherein the expansion locking device designed to be inserted into a conical hole, defined by the set of sector like elements and providing two locking systems operating in parallel plane inside the column comprises a threaded rod at the inner end of which is fixedly connected a conical washer, while a second toric washer is freely mounted about an intermediated zone of said rod, said second washer having an outer diameter lightly less than the inner diameter of the conical hole at the level where said second washer is positioned in its inoperative condition but greater than the minimum inner diameter of said hole, on said second washer resting a first control nut with the interposition of a metal washer said control nut being designed to be screwed on said threaded rod in order to relatively approach said first and second washers made of elastically deformable material one to another at the larger outer end of said conical hole an annular grooved shoulder being arranged designed to receive an abut flanged disc mounted on said rod and on which a second safety lock nut is screwed.

8. A table construction, comprising a vertical column having respective ends with a top cylindrical and bottom cylindrical cavity opening upwardly and downwardly respectively, an upright vertically extending securing bolt centrally arranged in each top and bottom cavity and secured to the inner end of said column, a plurality of table top supporting arm members each having a central sector portion engageable in said top cavity and disposed in side by side relationship around the respective securing bolts in said top cavity, each table top supporting arm member having a table top support arm extending radially outwardly from the top of said column, a plurality of foot members, each having a central vertical sector portion disposed in the bottom cylindrical cavity in side by side relationship around the respective securing bolt in said bottom cavity, an elastic sleeve disposed around each securing bolt between said securing bolt and said sector portions of the respective top supporting arm members and said foot members, and threaded clamping means connected to said bolt and to said elastic sleeve and being threadable on said bolt to act on said sleeve to engage it between said clamping bolt and said sector portions to hold respective sector portions in said column.

9. A table construction according to claim 8 wherein said threaded clamping means includes a sleeve disposed around each clamping bolt, a washer on said clamping bolt adjacent each end of said sleeve, the bottom one of said washers bearing against said elastic sleeve, and a nut threaded onto said bolt and engageable with the top one of said washers.

10. A table construction according to claim 9 wherein said bottom one of said washers is frustural conically shaped and has a side conical surface varying outwardly against said elastic sleeve.

11. A table construction according to claim 8 wherein said threaded clamping means includes the inner walls of said sector portions which are shaped to converge downwardly in said cavity, and means for forcing said elastic sleeve downwardly along said bolt into tight engagement with the downwardly and inwardly sloping walls of said sectors.

* * * * *